United States Patent [19]

Nuss et al.

[11] 4,199,381

[45] Apr. 22, 1980

[54] PREPARATION OF METALS FOR COLD FORMING

[75] Inventors: Karl-Heinz Nuss, Neu-Isenburg; Klaus-Dieter Nittel; Han-Yong Oei, both of Frankfurt; Gunter Siemund, Heusenstamm, all of Fed. Rep. of Germany

[73] Assignee: Oxy Metal Industries Corporation, Warren, Mich.

[21] Appl. No.: 933,369

[22] Filed: Aug. 14, 1978

[30] Foreign Application Priority Data

Aug. 16, 1977 [DE] Fed. Rep. of Germany ..... 2736874

[51] Int. Cl.[2] ..... B21B 27/06; B21C 9/00; C23F 7/10

[52] U.S. Cl. ..... 148/6.15 R; 148/6.15 Z; 252/34; 252/22; 252/23; 72/42

[58] Field of Search ..... 252/22, 23, 34; 148/6.15 Z, 6.15 R; 72/42

[56] References Cited

U.S. PATENT DOCUMENTS

| | | | |
|---|---|---|---|
| 2,921,865 | 1/1960 | Kubic | 148/6.15 Z |
| 3,377,278 | 4/1968 | Ruzza | 252/23 |
| 3,408,843 | 11/1968 | Treat | 252/39 |

OTHER PUBLICATIONS

Handbook of Chemistry and Physics, 43rd ed., 1962, pp. 1486, 1487.

*Primary Examiner*—Ralph S. Kendall
*Attorney, Agent, or Firm*—Arthur E. Kluegel; Richard P. Mueller

[57] ABSTRACT

The application of an aqueous soap to a phosphatized metal surface is improved by including in the soap composition a complex former stable to hydrolysis and capable of forming a water-soluble complex with the metal of the phosphate coating.

4 Claims, No Drawings

PREPARATION OF METALS FOR COLD FORMING

BACKGROUND OF THE INVENTION

The invention relates to an improved procedure for facilitating the cold-forming of metals, more particularly iron and steel, by phosphatizing and subsequent treatment with an aqueous lubricant having a soap base.

It has been known for many years to use phosphatizing to facilitate the cold-forming, without machining, of metals. The processes by far the most frequently used in all types of cold-forming are zinc-phosphatizing systems, mainly processes accelerated with nitrate, vitrite and chlorate. Manganese-phosphatizing processes have also been used for difficult cold-forming operations. Zinc-calcium processes and alkali-phosphatizing processes are also used occasionally for specific applications.

During cold-forming, phosphate coatings provide a good separating effect between the tool and the surface of the metal, but a decisive factor, in addition to this, is the avantageous effect of the coating upon the lubricants used. Considerable use is made in practice of the lubricants having a soap base in conjunction with phosphate coatings. For example, alkali soaps can partly transform zinc-phosphate coatings on the workpiece in such a manner as to produce a highly effective zinc soap.

The reaction is generally obtained by immersing the phosphatized and rinsed workpieces in an aqueous saponifying bath, at temperatures of between 70° and 80° C. for between 2 and 5 min. A far-reaching reaction, and therefore better conversion, are sought with specially reactive soap lubricants, the immersion baths containing more than 2% thereof and having a pH value of between 8 and 10. It is possible in this way to obtain total soap deposits of up to about 5 g/m$^2$ which adhere well to the workpiece, with simultaneous conversion to zinc soap which may then constitute up to 50% of the total coating of lubricant. The coating of soap also contains unreacted alkali soap, especially sodium soap, since it is customary to use sodium-soap baths. The concentration of the soap baths is usually between 2 and 5%. The lubricating properties may often be improved by adding to the solutions inorganic pigments, for example graphite, molybdenum disulphide, borax, sodium pyrophosphate, or metal soaps which are difficult to dissolve, such as calcium-, aluminum, or barium-stearate. The use of surfactant substances, e.g. alkoxylated alkyl phenols, has been found to improve the dispersion of pigments having a metal-soap base.

In many cases, however, e.g. for difficult cold-forming operations such as cold-extrusion, total soap deposits of up to 5 g/m$^2$ are not adequate, since the formed parts exhibit striations. Considerably thicker total-soap deposits are therefore desired. It is known that the amount of soap deposited may be increased by increasing the concentration of the soap bath, raising the pH value thereof, using a soap containing a large proportion of $C_{18}$ soaps, or lowering the temperature of the bath until the soap solution is all most solid. However, none of these steps has been found satisfactory in practice since, in spite of the increase in the weight of the soap deposit, it is impossible to achieve uniform coverage, and the layer of soap does not adhere well to the phosphate base. It is then easily stripped during cold-forming. Furthermore it builds up on the presses which therefore become dirty and need frequent cleaning. This is not only costly, but the material wasted by build-up on the presses is an additional loss factor leading to uneconomical results.

It is therefore the purpose of the invention to provide a procedure which leads, in processes of the type described hereinbefore, to increased total-soap deposits with better adhesion and uniformity, and therefore to improved technical effectiveness and increased economy.

SUMMARY OF THE INVENTION

According to the invention, this purpose is achieved by the addition of a complex-former, adapted to form water-soluble complexes with the metal in the phosphate coating, to an aqueous lubricant having an alkali-soap base. The addition of the complex-former to the soap bath leads to a substantial improvement in the adhesion of the layer of soap to the phosphate coating. This addition also usually results in a considerable increase in the total-soap deposit and uniformity of coverage.

DETAILED DESCRIPTION OF THE INVENTION

In the case of soaps which contain at least 90% of $C_{18}$ soaps, and which of themselves already produce increased soap deposits, the addition of the complex-former does not increase the amount of the deposit so much, but in spite of this it produces a more uniform layer which adheres better to the workpiece.

Any type of complex-former, which cannot be hydrolyzed, but which produces water-soluble compounds with the metal in the phosphate coating, e.g. zinc, manganese, calcium, iron, may be used in the process according to the invention. Use is preferably made of the anions of ethylene diamine tetra-acetic acid and/or nitrilo-tri-acetic acid. Other usable complex-forming anions are, for example these based on; trans-1,2-diaminocyclohexane tetra-acetic acid, diethylene triamine penta-acetic acid, N-hydroxy ethylene diamine tri-acetic acid, N,N-di ($\beta$-hydroxyethyl) glycin, and sodium glycoheptonate. The complex-formers are preferably added to the soap in the form of their alkali salts.

Complex-formers which are easily hydrolyzed, and which thus quickly lose their effectiveness, such as condensed phosphates, are unsuitable for the purposes of the invention.

The appropriate concentration of complex-former in the soap bath is governed by the ability of the complex-former to form complexes. Concentrations of between 0.1 and 10 g/l have been found generally satisfactory.

The soap concentration may be between 10 and 100 g/l, preferably consisting of more than 40% of $C_{18}$ soaps.

In order to improve the lubricating properties, the soap baths may also contain, as is known, inorganic pigments such as, for example, graphite, $MoS_2$, borax and sodium-pyrophosphate, or also metal soaps which are difficult to dissolve, such as calcium, aluminum or barium-stearate. The use of surfactant substances, such as alkoxylated nonyl phenols, has been found to improve the dispersion of metal-soap-based pigments.

Depending upon the concentration, the temperature at which the aqueous soap-containing solutions or suspensions should be used is preferably between 60° and 80° C. Treatment time is governed by the mass of the parts treated and severity of cold-forming. The parts must be treated in the soap solution until they have absorbed enough heat to dry in the air. This usually takes between 3 and 5 minutes.

As compared with conventional soap-containing baths, the procedure according to the invention also provides the advantage that the treatment temperature of the baths can be lowered below the temperature at which conventional baths start to gel. This makes it possible to save heat energy.

The advantages of the procedure proposed according to the invention are covered further in the following example.

EXAMPLES

Steel stampings were treated as follows:

(a) pickling in 20% sulphuric acid at 65° C., 15 minutes;
(b) rinsing with cold tap-water, 1 minute;
(c) rinsing with water at 80° C., 1 minute;
(d) phosphatizing with a nitrate-accelerated zinc-phosphatizing system at 98° C., 10 minutes; the thickness of the phosphate coating was 15μ;
(e) rinsing with cold water, 1 minute;
(f) immersion in aqueous soap compositions as described in Table 1 at 73° C., 3 minutes;
(g) drying in the air.

TABLE 1

| | SOAP COMPOSITIONS | | | | | | |
|---|---|---|---|---|---|---|---|
| Composition | 1 | 2 | 3 | 4 | 5 | 6 | 7 |
| Sodium soap with 50% $C_{18}$component | 50 g/l | 100 g/l | 50 g/l | 50 g/l | 50 g/l | | |
| Sodium soap with 90% $C_{18}$component | | | | | | 50 g/l | 50 g/l |
| Ethylene diamine tetra-acetic acid | | | | 2 g/l | | | |
| Nitrilo-tri-acetic acid | | | | | 2 g/l | | |
| pH value | 10 | 10 | 11 | 10 | 10 | 10 | 10 |

After this treatment, the layer of soap was assessed visually and the deposit was determined by differential weighing after the layer of soap had been removed with boiling water and perchlorethylene vapor. The results are given in Table 2.

TABLE 2

| | DEPOSITED COATINGS | |
|---|---|---|
| Example | Soap Deposit g/m² | Visual Assessment |
| 1 | 4,7 | grey, adheres well, uniform |
| 2 | 17,2 | white, does not adhere well, not uniform |
| 3 | 10,5 | white, does not adhere well, not uniform |
| 4 | 17,4 | white, adheres well, uniform |
| 5 | 11,0 | white, adheres well, uniform |
| 6 | 18,0 | white, does not adhere well, not uniform |
| 7 | 18,0 | white, adheres well, uniform |

The parts with their different layers of soap were then cold-extruded to form cups. The forming results are given in Table 3.

TABLE 3

| | COLD EXTRUSION |
|---|---|
| Example | Forming results |
| 1 | Poor (the formed parts had striations) |
| 2 | Good (but the press had to be cleaned after a few parts because of soap build-up) |
| 3 | Better than Example 1, but still unsatisfactory (additional lubrication in the press with $MoS_2$ was required in order to eliminate striations) |
| 4 | Good (no build-up on the press) |
| 5 | Good (no build-up on the press; no additional lubrication in the press with $MoS_2$ needed) |
| 6 | Good (build-up on the press) |
| 7 | Good (little build-up on the press). |

What is claimed is:

1. In a process for facilitating the cold-forming of metals by phosphatizing and subsequent treatment with an aqueous lubricant having an alkali-soap base, the improvement comprising employing a lubricant consisting essentially of between 10 and 100 g/l of alkali soap and between 0.1 and 10 g/l of a complex-former of at least one compound selected from the group consisting of EDTA; NTA; trans-1,2-diamino cyclohexane tetra-acetic acid; diethylene triamine penta-acetic acid; N-hydroxy ethylenediamine tri-acetic acid; N,N-di (β-hydroxyethyl) glycin; sodium glycoheptonate and the alkali metal or ammonium salts of any of the foregoing.

2. The process of claim 1 wherein the aqueous, soap-containing lubricant comprises more than 40% of $C_{18}$ alkali metal soaps.

3. The process of claim 1 wherein the soap deposit is in excess of 5 g/m².

4. The process of claim 1 wherein the soap coating is dried prior to cold forming.

* * * * *